US008402636B2

(12) United States Patent
Park et al.

(10) Patent No.: US 8,402,636 B2
(45) Date of Patent: Mar. 26, 2013

(54) METHOD OF MANUFACTURING GROUND-BURIAL TYPE SOLID INSULATED TRANSFORMER

(75) Inventors: Jong Tae Park, Seoul (KR); Byung Kwon Song, Seoul (KR); Kee Ha Hwang, Daejeon (KR); Tae Ho Kim, Chungcheongbuk-do (KR); Ki Hak Yi, Daejeon (KR)

(73) Assignee: Cheryong Industrial Co., Ltd., Seoul (KR)

( * ) Notice: Subject to any disclaimer, the term of this patent is extended or adjusted under 35 U.S.C. 154(b) by 71 days.

(21) Appl. No.: 13/060,893

(22) PCT Filed: Aug. 28, 2009

(86) PCT No.: PCT/KR2009/004823

§ 371 (c)(1),
(2), (4) Date: Feb. 25, 2011

(87) PCT Pub. No.: WO2010/024617

PCT Pub. Date: Mar. 4, 2010

(65) Prior Publication Data

US 2011/0146063 A1 Jun. 23, 2011

(30) Foreign Application Priority Data

Sep. 1, 2008 (KR) ..... 10-2008-0085777
Feb. 3, 2009 (KR) ..... 10-2009-0008528

(51) Int. Cl.
*H01F 7/06* (2006.01)

(52) U.S. Cl. ..... 29/605; 29/602.1; 29/604; 29/609; 72/142; 72/144; 72/225; 72/289; 342/443; 342/447.2; 342/437.3; 342/437.4; 336/58; 336/60; 336/212; 336/234

(58) Field of Classification Search ..... 29/592.1, 29/602.1, 604, 605, 609; 72/142, 144, 225, 72/242, 289; 242/443, 447.2, 437.3, 437.4, 242/478.1, 614.2, 25 R; 336/58, 60, 212, 336/234

See application file for complete search history.

(56) References Cited

U.S. PATENT DOCUMENTS

| | | | | | |
|---|---|---|---|---|---|
| 3,611,225 | A | * | 10/1971 | Dakin | 336/58 |
| 3,775,719 | A | * | 11/1973 | Gainer et al. | 336/58 |
| 5,621,372 | A | * | 4/1997 | Purohit | 336/60 |
| 5,923,236 | A | * | 7/1999 | Rapoport et al. | 336/212 |
| 2008/0061919 | A1 | * | 3/2008 | Marek et al. | 336/207 |

FOREIGN PATENT DOCUMENTS

| | | | |
|---|---|---|---|
| JP | 07-106162 | A | 4/1995 |
| JP | 2003-158018 | A | 5/2003 |
| KR | 10-0509982 | B1 | 8/2005 |
| KR | 10-2006-0015657 | A | 2/2006 |

* cited by examiner

OTHER PUBLICATIONS

International Search Report, Appln No. PCT/KR2009/004823, dated Apr. 23, 2010.

*Primary Examiner* — Paul D Kim
(74) *Attorney, Agent, or Firm* — Kile Park Reed & Houtteman PLLC

(57) ABSTRACT

A manufacturing method of ground-buried-type solid insulation transformer includes producing a coil form into which an inner window is formed; winding a low voltage coil and a high voltage coil on the coil form to produce a first coil part; winding glass fiber on the first coil part to produce a second coil part and assembling a first mold into the inner window and then pre-heating the second coil part; putting the second coil part into a second mold and injecting epoxy resin and hardener between the second coil part and the second mold, and automatically molding and curing thereof under predetermined speed, vacuum, pressure and temperature to produce a third coil part on outer circumference of which an epoxy layer is formed; separating the first mold from the inner window of the third coil part and then after-treating and curing the third coil part; cooling the after-treated and cured third coil part and sanding and washing the epoxy layer, and applying semi-conductive coating material to the sanded part to produce a fourth coil part; assembling a core to the fourth coil part to produce a fifth coil part and testing the fifth coil part; and connecting the fifth coil part to a conductive mesh and shielding thereof, and then sealing outer side of the fifth coil part and filling silicone or high molecular weight compound between the fifth coil part and a shell to manufacturing the transformer.

10 Claims, 12 Drawing Sheets

METHOD OF MANUFACTURING GROUND-BURIAL TYPE SOLID INSULATED TRANSFORMER

FIELD OF THE INVENTION

The present invention relates to a manufacturing method of a ground-buried type solid insulation transformer, and more particularly, to a manufacturing method of a ground-buried type solid insulation transformer in which solid is used as dielectric medium instead of liquid or gas.

BACKGROUND OF THE INVENTION

Generally, it has been well known in the art that each of primary winding and secondary winding (coils) of a dry type transformer is treated with solid type cast material in order to provide a dry type transformer in which dielectric liquid or gas is used as an electrical insulating medium and for diffusing heat created in the windings (coils) or in the transformer core.

In addition, an oil-filled transformer using liquid such as oil as dielectric material as an electrical insulating medium and for diffusing heat created in the windings (coils) or in the transformer core, classified as above-ground-type, overhead-type and underground-type, etc. Here, a dry type transformer using gas such as circulating air as dielectric material is classified as ground-type and underground-type, which generally raise drawbacks of not having resistance against natural chemical reaction when exposed to ground or underground surrounding.

The manufacturing of the solid type or dry type transformer has been succeeded but is limited to transformer with relatively low power. Furthermore, the prior art of solid type or dry type transformer or a method of manufacturing of the same has some problems as follows.

First, in case of the prior art of the solid type or dry type transformer the thermal diffusion through solid type dielectric material is limited and the accumulated heat inside windings can produced hot spots or high thermal gradients that can lead to cracks and produce electrical arcs in the solid insulation system. In particular, in some cases, the breakdown of the solid insulation of the transformer may lead to transformer failure to operate properly. The cracks produced in the transformer can make the transformer mechanically unstable (breakage of transformer coils) which can lead to further break down of the dielectric media between coils and within core or within coils. The electric arc produced within the solid insulation material weakens the dielectric strength of the solid type insulation material, causing break down of the solid insulation system leading to severe damages or even to the explosion of the transformer. In addition, oil-filled transformer using transformer oil as dielectric insulation material, can caused environmental contamination when oil leaks out of the transformer tank when the tank is damaged due to corrosion or when the tank is ruptured due to the transformer failure.

A prior art manufacturing method of an above-ground dry type transformer requires a protective enclosure which is electrically connected to ground in order to eliminate risks of electric shocks to human beings or to animals wherein the protective enclosure is made of metal, such as steel, and large enough to cover the active part of the transformer (core and coils) and to provide enough electrical clearance between the active part and the grounded enclosure. The drawback of such a transformer arrangement is a large space requirement for installation which makes it difficult to install in small space.

Additionally, the expansion and contraction due to the temperature variations within the coil cause mechanical stresses to the transformer coils.

Furthermore, in the prior art of dry-type transformer, when a large transformer, such as a power distribution transformer, is manufactured using a dielectric cast resin material, it is difficult to cure the cast resin material uniformly in order to provide uniform physical and dielectric properties to the overall body of the transformer.

Underground Oil-filled type, solid type or dry type transformer has been proposed in order to solve the aforementioned drawbacks of the above-ground type transformer, however, it has not solved the corrosion problem on its surface causing the oil leakage and etc. when it has been buried and operated in underground for a long time.

FIG. 1 shows process order of prior manufacturing method of a transformer. As shown in FIG. 1, it includes low voltage winding process (S10), high voltage winding process (S20), core and coils assembling process (S30), frame assembling process (S40), final assembling process (S50). However, according to the prior manufacturing method, it is difficult to manufacture solid type insulation, which may overcome drawbacks of solid type or dry type transformer.

SUMMARY OF THE INVENTION

The present invention has been proposed to solve the aforementioned drawbacks of the prior art, and one object of the present invention relates to provide a manufacturing method of a ground-buried solid type insulation transformer whereby, in case of a physical contact by human or animals to the outer case, an electric shock due to the electric field produced from the windings' wires within the solid type insulation transformer, can be avoided, and whereby even in case of being buried underground and submerged for long time underwater, corrosion can be avoided.

In order to achieve the aforementioned object, the manufacturing method of ground-buried solid type insulation transformer includes nine processes. That is, the manufacturing method of ground-buried solid type insulation transformer comprises: producing a coil form into which an inner window is formed (first process); winding a low voltage coil and a high voltage coil on the coil form to produce a first coil part (second process); winding glass fiber on the first coil part to produce a second coil part and assembling a first mold into the inner window of the coil form and then pre-heating the second coil part (third process); putting the second coil part into a second mold and injecting epoxy resin and hardener between the second coil part and the second mold, and automatically casting and curing thereof under predetermined speed, vacuum degree, pressure and temperature to produce a third coil part on outer circumference of which an epoxy layer is formed (fourth process); separating the first mold from the inner window of the third coil part and then curing the third coil part (fifth process); cooling the after-treated and cured third coil part and sanding and washing the external epoxy layer, and applying semi-conductive coating material to the sanded part to produce a fourth coil part (sixth process); assembling a core to the fourth coil part to produce a fifth coil part and testing the fifth coil part (seventh process); and connecting the fifth coil part to a conductive mesh and shielding thereof, and then sealing outer side of the fifth coil part and filling silicone or high molecular weight compound between the fifth coil part and the shell made either of Vinlyester resin, Fiber Reinforced Polyester (FRP), or thermoplastic material to manufacture a transformer (eighth process); and final testing the transformer (ninth process).

According to the ground-buried solid type insulation transformer manufactured by the present method, in case of a physical contact by human beings or animals to the outer case, an electric shock due to the electric field produced from the windings' wires within the solid type insulation transformer, can be avoided In addition, windings are surrounded by the shell and silicone or high molecular compound and thus mechanically stable configuration can be obtained and even in case of being buried underground and being in underwater for a long time, corrosion can be avoided.

DETAILED DESCRIPTION OF THE PREFERRED EMBODIMENTS

The preferred embodiments of a manufacturing method of a ground-buried type solid insulation transformer according to the present invention will be described in detail referring to the accompanied drawings. However, it has to be understood that the present invention is not limited to the provided embodiments without departing from a spirit of the present invention.

Figure 1:
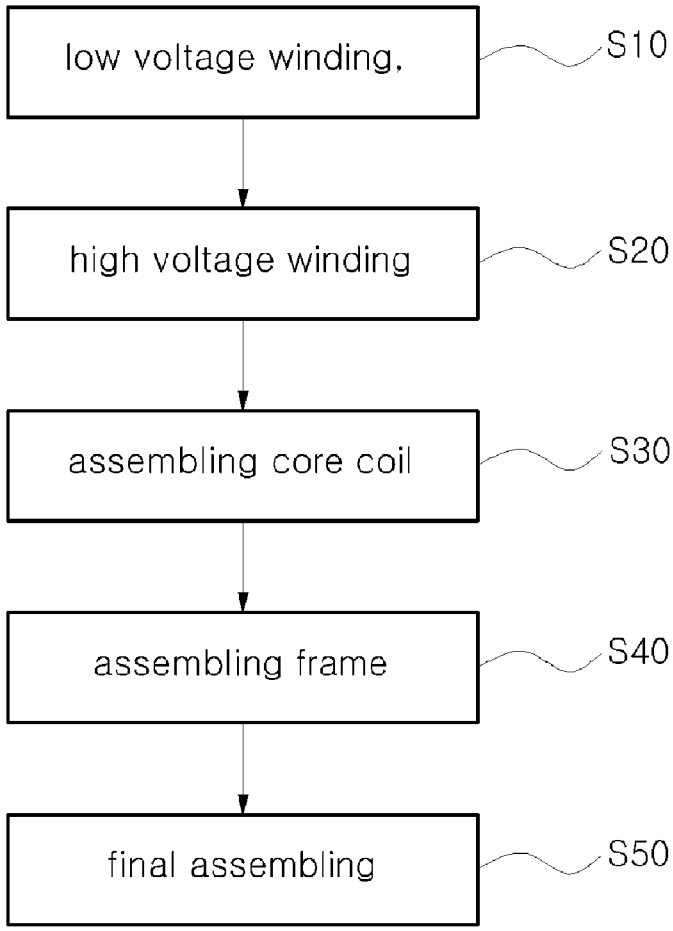
FIG. 1 shows a manufacturing method and processing order in the prior art.
Figure 2:
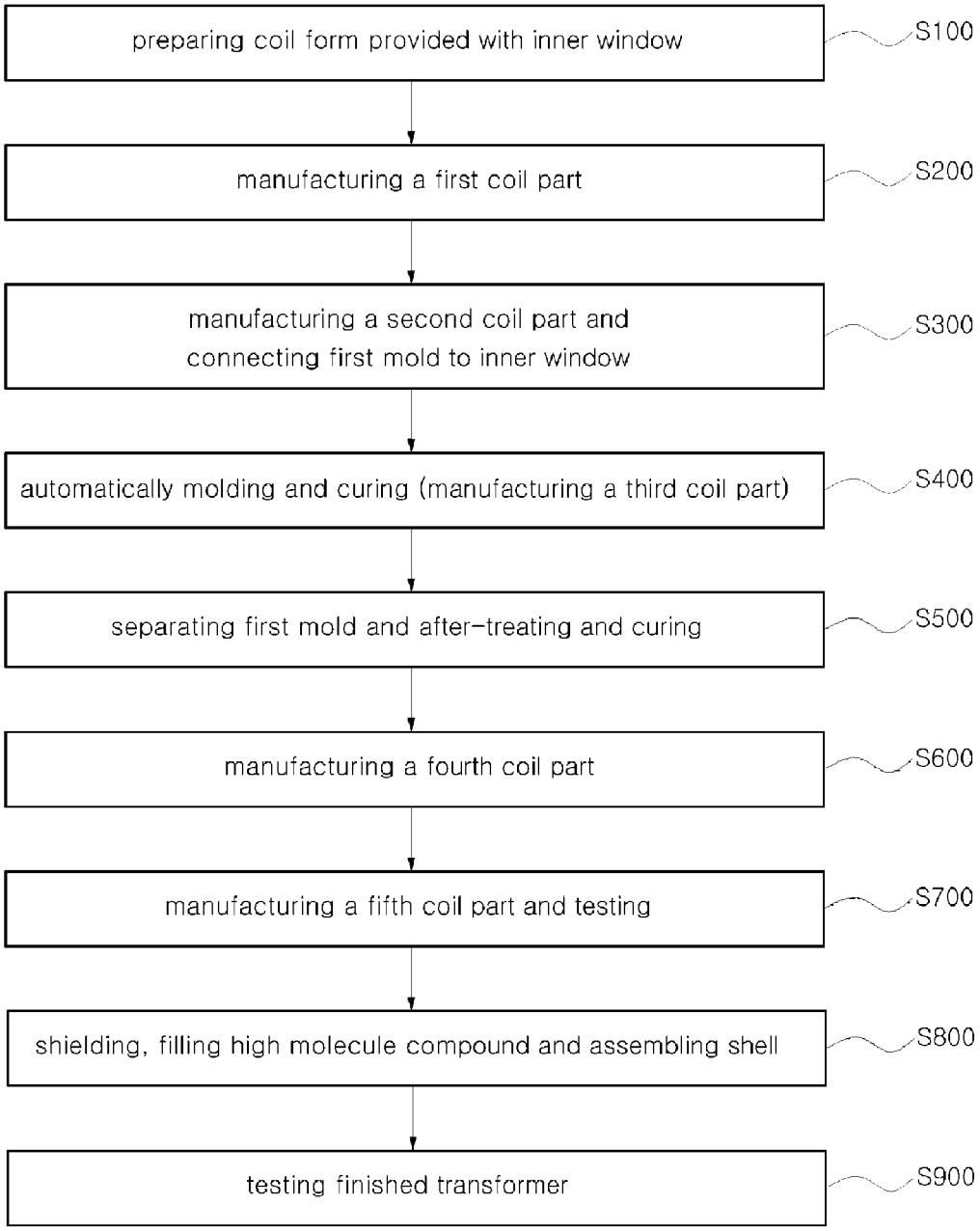
FIG. 2 shows processing order of a manufacturing method of a ground-buried type solid insulation transformer according to one embodiment of the present invention.

Referring again to accompanied drawings, FIG. 2 shows schematically a processing order of a manufacturing method of ground-buried type solid insulation transformer according to one embodiment of the present invention. Referring to FIG. 2, the manufacturing method of a ground-buried type solid insulation transformer includes nine processes (S100-S900). That is, each process of the nine processes (S100-S900) is as follows:

Through a first process S100 a coil form 10 is provided in which an inner window 11 is formed.

Through a second process S200 a low voltage coil 20 and a high voltage coil 21 are wound on the coil form 10 to produce a first coil part 100.

Through a third process S300 a glass fiber is wound on the first coil part 100 to produce a second coil part 200 and the second coil part 200 is pre-heated after a mold 30 which is formed corresponding to the inner window is assembled and inserted.

Through a fourth process S400 the second coil part 200, into which the mold 30 is inserted, is placed in a mold 40 and epoxy resin and hardener are injected to the second coil part 200 through the extra part of the mold 40 and then automatically casted-cured to produce a third coil part 300 in predetermined speed, vacuum degree, pressure and temperature.

Through a fifth process S500 the third coil part 300 is separated from the mold 40 and the mold 30 is separated from the inner window 11 and then the third coil part 300 is after-treated and cured.

Through a sixth process S600 the third coil part 300 is cooled and then sanded and washed. A fourth coil part 400 is produced by applying a coating material 43 of semi-conductive on the sanded region of the third coil part 300.

Through a seventh process S700 a core 50 is assembled to the fourth coil part 400 to produce a fifth coil part 500 and then the fifth coil part is tested.

Through a eighth process S800 a conductive mesh 51 is attached to the fifth coil part 500 and the fifth coil part 500 is shielded, and then a shell 52 is assembled thereto. The transformer 600 is produced by filling silicone or high molecular weight compound between the fifth coil part 500 and the shell 52.

Through a ninth process S900 through the final test, the transformer 600 is completed.

Hereinafter, more details are described, referring to the accompanying drawings.

Figure 3:
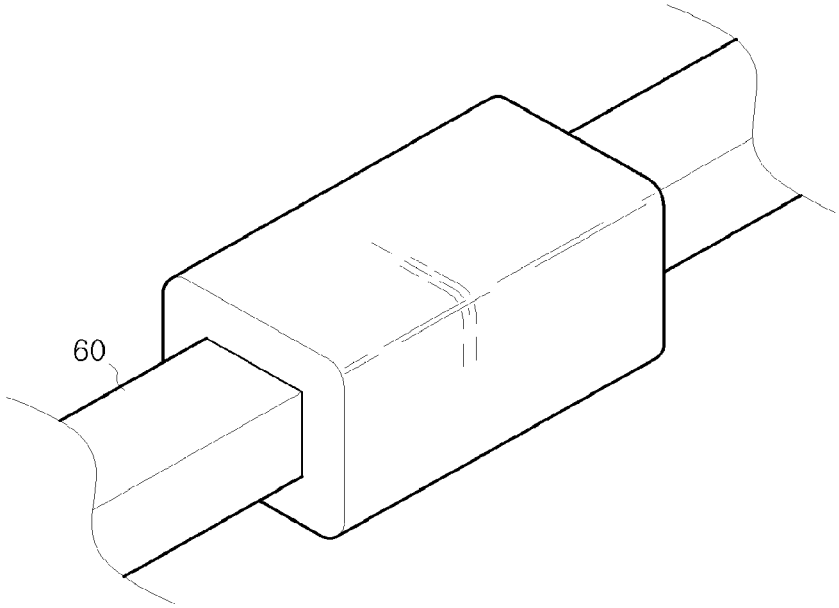
FIG. 3 shows schematically a holding device for insulation material being held according to another embodiment of the present invention.
Figure 4:
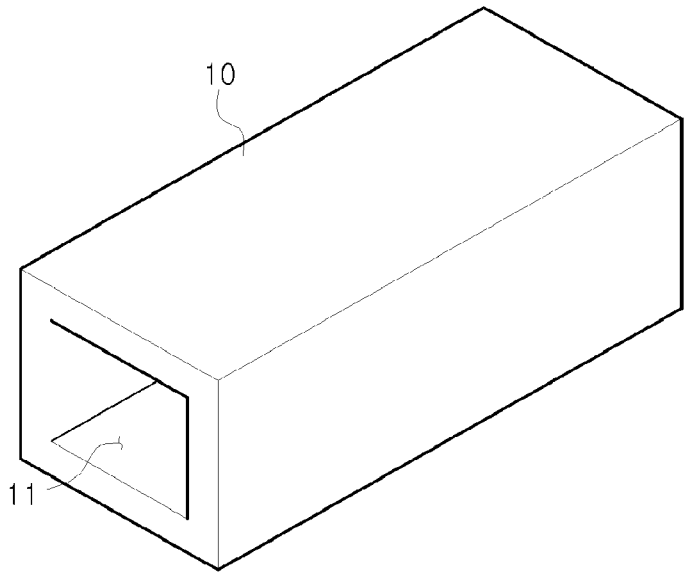
FIG. 4 shows schematically a finished coil form being used for a ground-buried type solid insulation transformer according to another embodiment of the present invention.
Figure 5:
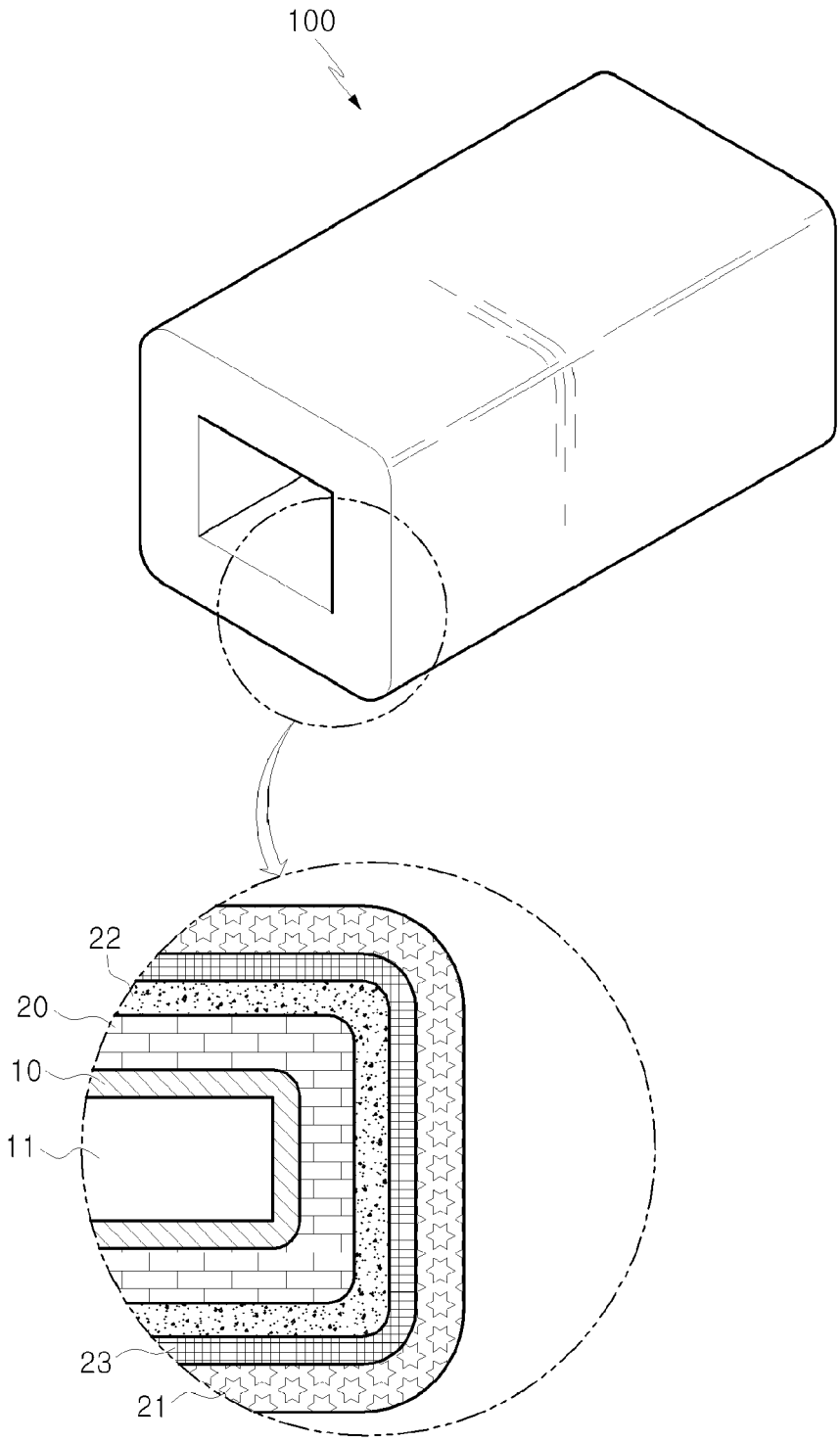
FIG. 5 shows schematically a first coil part appearance implemented on an outer circumference of the coil form and a section of the first coil part.
Figure 6:
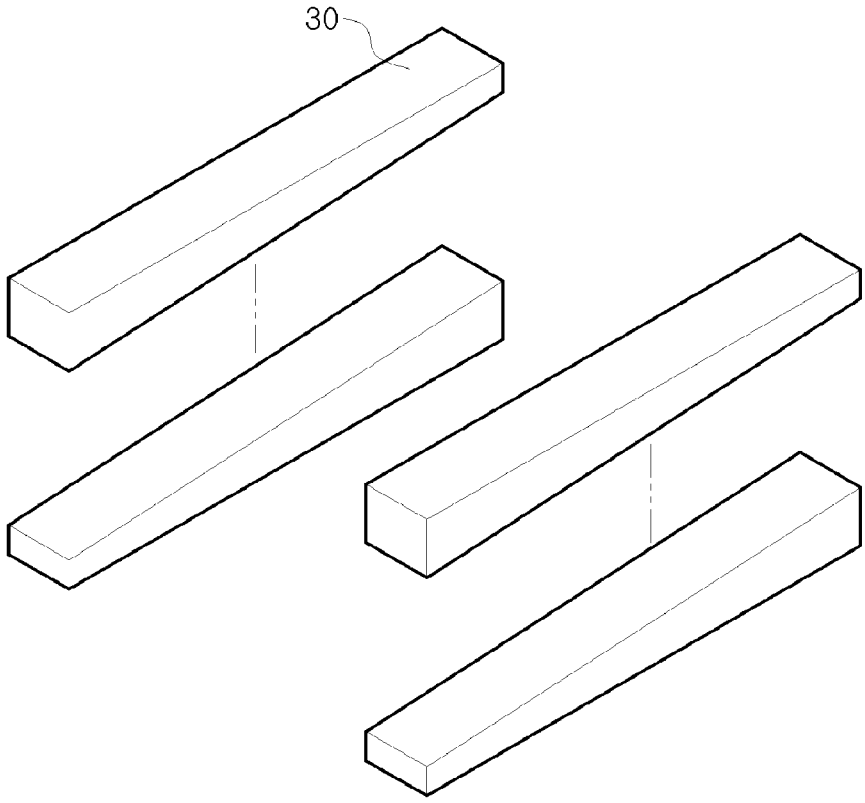
FIG. 6 shows schematically molds being inserted into an inner window of the coil form.

FIG. 3 shows insulation material which is held in a holding device. FIG. 4 shows a finished coil form. FIG. 5 shows an appearance of the first coil part and its cross section. FIG. 6 shows a mold to be inserted into an inner window of the coil form.

Referring to FIG. 3, insulation material is cut to a desired size and then held on a holding device 60 to produce a coil form 10 inside which inner window 11 is formed under a first process S100. Through a second process S200, referring to FIG. 5, a low voltage coil 20 and a high voltage coil 21 are wound on an outer circumference of the produced coil form 10 to produce a first coil part 100.

Under a third process S300 when the low voltage coil 20 is wound on the coil form 10, at least two or more of copper sheet, Insulation paper or film, glass fiber 22 and semi-conductive paper 23 are further wound on outer side of the low voltage coil 20 and at the same time silicone or nitrile rubber are inserted and wound, together with the low voltage coil 20, to mitigate thermal expansion of the low voltage coil 20.

Referring to high voltage coil 21 winding process, at least two or more copper wires, Insulation paper or film, Insulation spacer, glass fiber material and self-fusing tape are wound. In particular, the Insulation spacer is affixed longitudinally to Insulation paper or film at the predetermined distance in order to facilitate the epoxy resin and the hardener to infiltrate thereinto. Here, rectangular wire, round wire or flattened wire, made of aluminum or copper, is used to wind the high voltage coil 21. The flattened wire and rectangular wire may be preferably used to minimize coil size and increase short circuit strength.

Furthermore, the first mold 30 is assembled and inserted into the inner window 11. And, the first mold 30 is composed of tapered parts in order to facilitate assembly and disassembly thereof.

Figure 7:
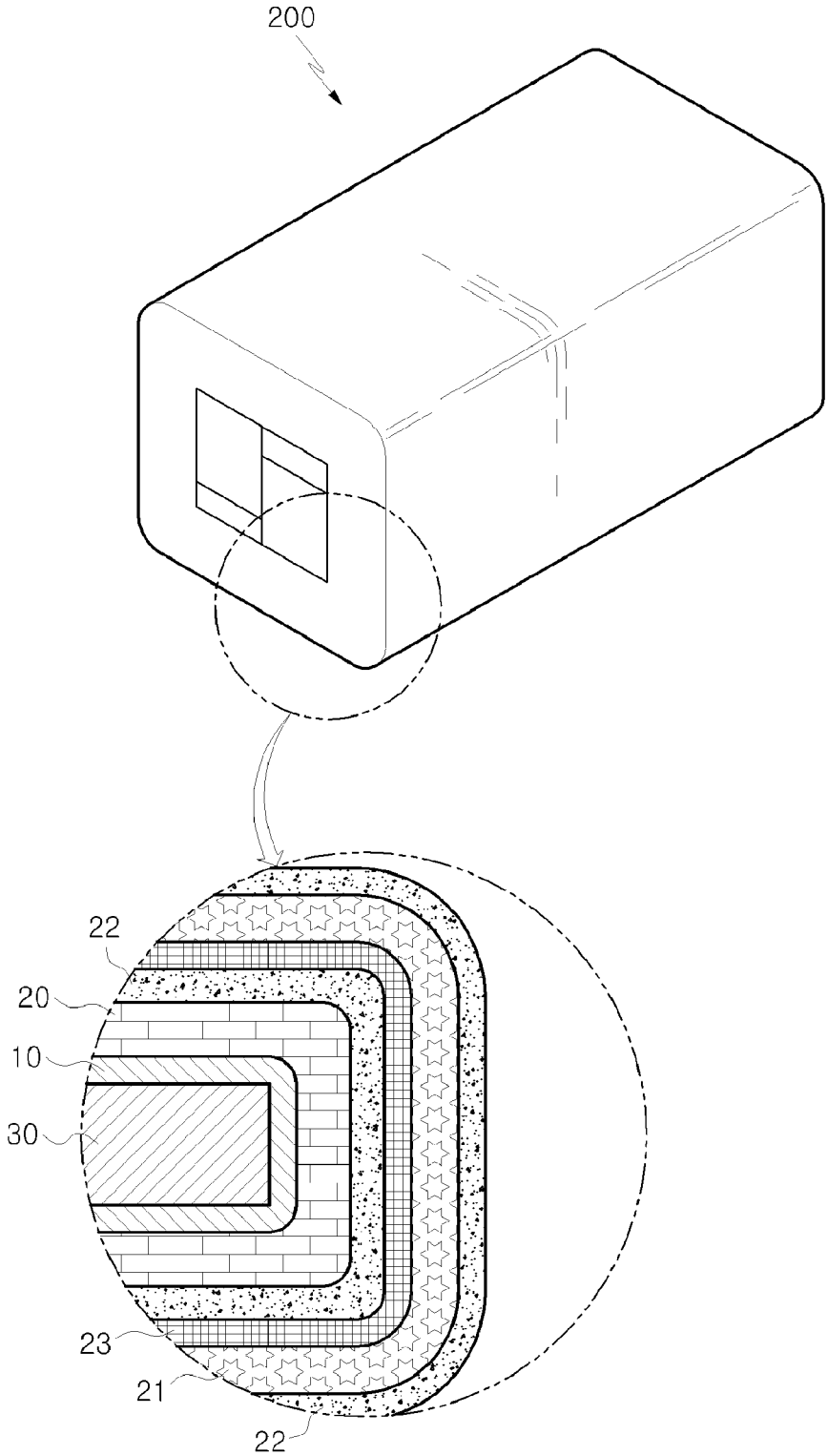
FIG. 7 shows schematically a second coil part produced after a third process of a manufacturing method of a ground-buried type solid insulation transformer according to another embodiment of the present invention, and a section of the second coil part.

FIG. 7 shows an appearance of the second coil part and its cross section. Meanwhile, the second coil part 200 is pre-heated for 8-20 hours at temperature between 80° C. and 250° C. to evaporate moisture contained therein after the aforementioned processes are performed.

Referring to the fourth process S400, the second coil part 200, into which the first mold 30 is inserted, is arranged inside a second mold 40 and an epoxy layer 42 is formed on outer circumference using epoxy resin and hardener which are injected through an epoxy injection port 41 and then automatically casted and cured under predetermined speed, vacuum, pressure and temperature to produce a third coil part 300.

Figure 8:
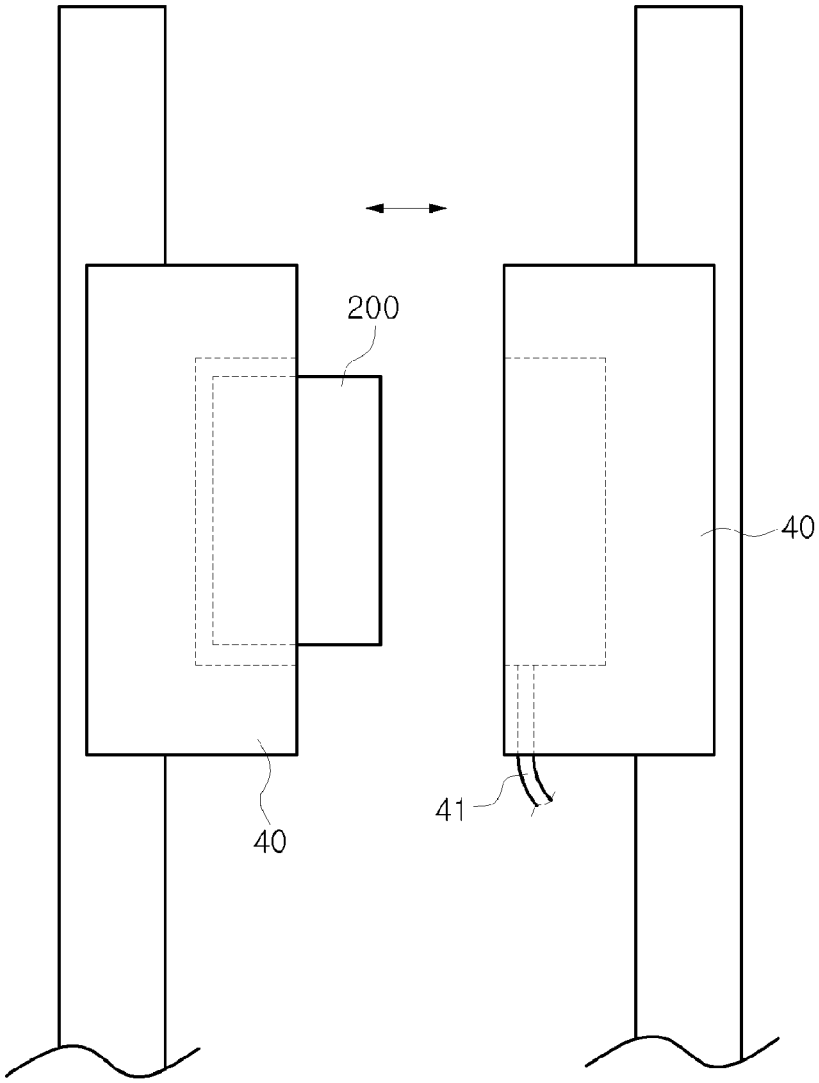
FIG. 8 shows schematically the second coil part installed on the mold.

FIG. 8 shows an appearance of the second coil part installed on the second mold. Referring to FIG. 8, the second mold 40 is configured as a predetermined shape depending on a transformer shape. The second coil part 200 is assembled or installed into the second mold 40 and epoxy resin and hardener are injected automatically under computer control through the epoxy injection port 41 and then automatically casted and cured under predetermined speed, vacuum, pressure and temperature to produce the third coil part 300, as shown in FIG. 9.

Figure 9:
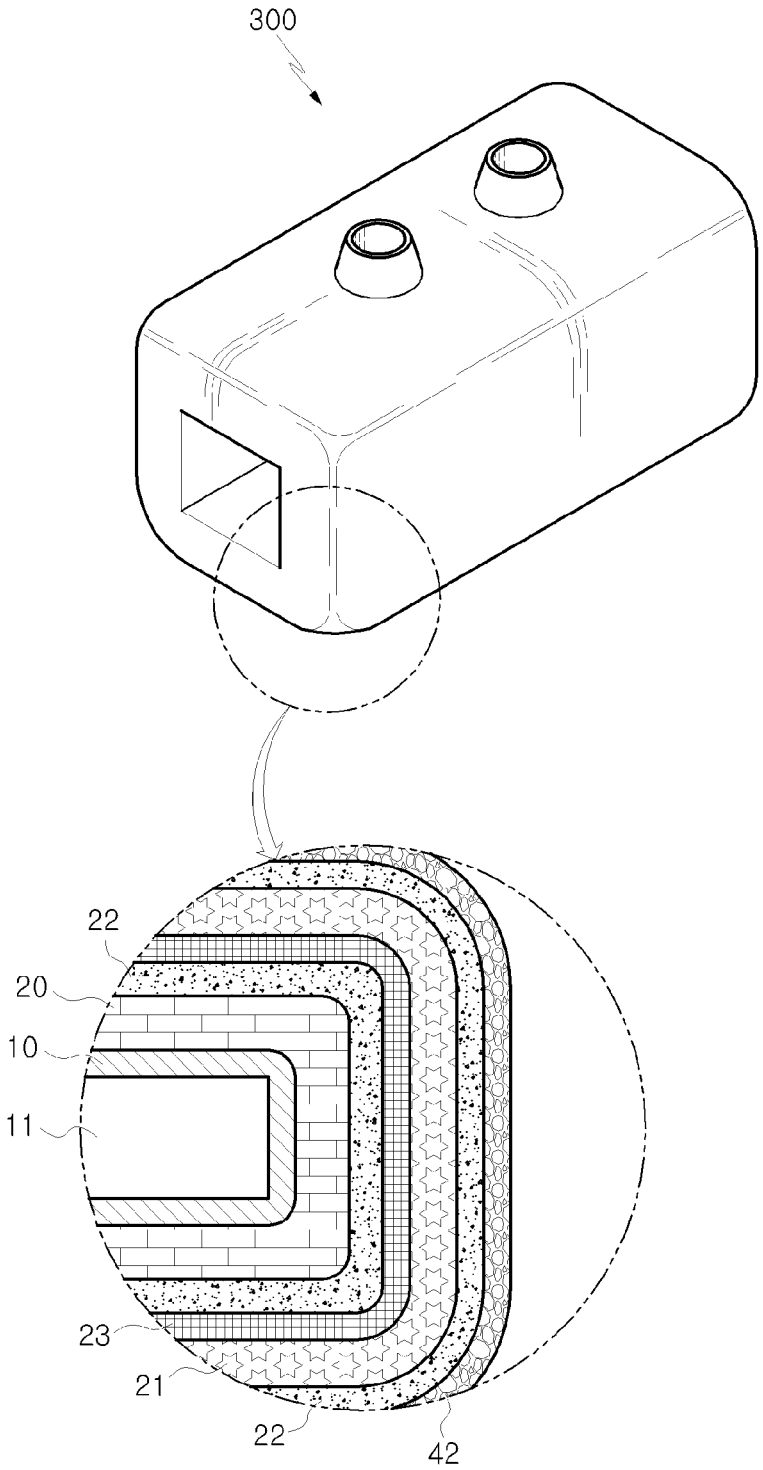
FIG. 9 shows schematically a third coil part 300 manufactured through a fourth process of a manufacturing method of a ground-buried type solid insulation transformer according to another embodiment of the present invention, and a section of the third coil.

FIG. 9 shows an appearance of the third coil part and its cross section. Here, epoxy resin and hardener are supplied through the epoxy resin injection port 41 formed on one side of the second mold 40 wherein the second mold 40 is kept at a temperature between 100° C. and 200° C., and epoxy resin and hardener is kept at a temperature between 50° C. and 150° C. and under vacuum level of 1 mbar to 80 mbar during filling and maintained at 2 bar to 20 bar of epoxy resin injection pressure within the second mold 40 for 30 min to 2 hr in order to make epoxy gel or gel state.

In fifth process S500, the first mold 30 is separated from inner window 11 of the third coil part 300 and then after-treated and cured. Here, the third coil part 300 is cured at 60-250° C. to solidify the third coil part 300 in the after-treatment and curing process of the fifth process S500, and in particular the third coil part 300 may be cured preferably at a temperature between 100° C. and 200° C.

In sixth process S600 the third coil part 300 is cooled and then outer surface of epoxy layer 42 is sanded and washed so that epoxy paint (semi-conductive coating material 43) can be applied on epoxy layer 42 formed on outer surface of the third coil part 300. In addition, the sanded part of epoxy resin is coated with semi-conductive epoxy paint to produce a fourth coil part 400.

Figure 10:
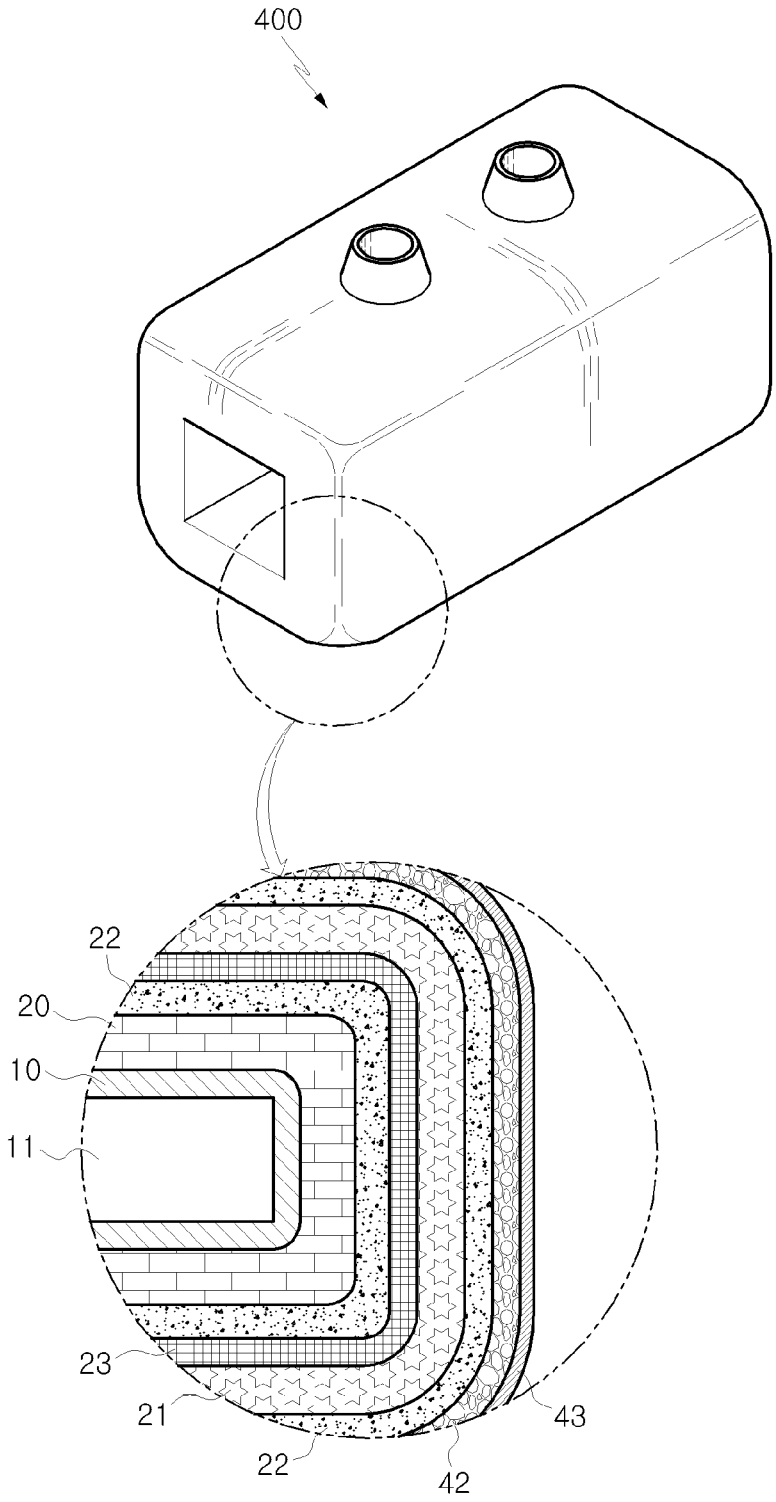
FIG. 10 shows schematically a fourth coil part 400 manufactured through a sixth process of a manufacturing method of a ground-buried type solid insulation transformer according to another embodiment of the present invention, and a section of the fourth coil.

FIG. 10 shows an appearance of the fourth coil part and its cross section. In the seventh process S700, a core 50 is assembled to the fourth coil part 400 to produce and test a fifth coil part 500.

Figure 11:
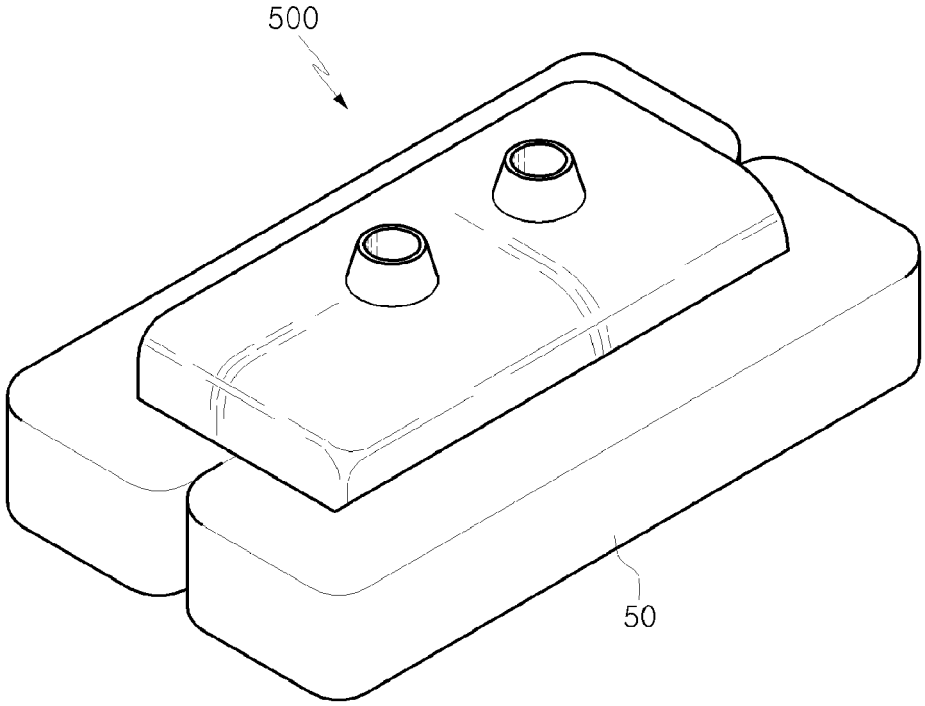
FIG. 11 shows schematically a fifth coil part 500 manufactured through a seventh process of a manufacturing method of a ground-buried type solid insulation transformer according to another embodiment of the present invention.

FIG. 11 shows an appearance of the fifth coil part. In an eighth process S800, the fifth coil part 500 is attached with a conductive mesh 51 and shielded and then the shell 52 is assembled and silicone or high molecular weight compound is filled between the fifth coil part 500 and the shell 52.

Figure 12:
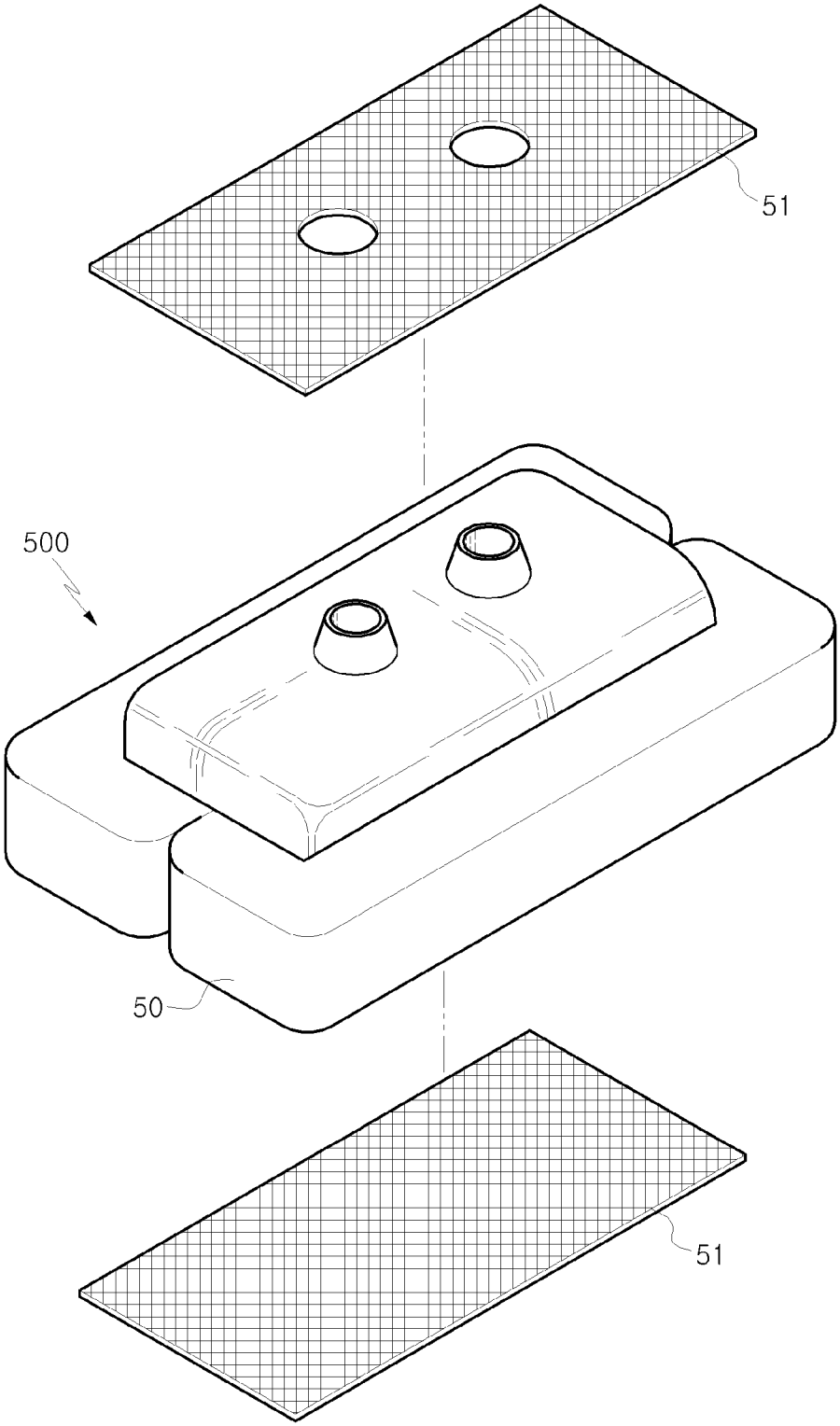
FIG. 12 shows schematically conductive mesh and the fifth coil part, which are disassembled.

FIG. 12 shows an attaching manner of the conductive meshes to the fifth coil part. Referring to FIG. 12, the conductive meshes 51 made of copper or aluminum are arranged over semi-conductive epoxy paint 43 of respective upper and lower part of the fifth coil part 500. Also the conductive meshes 51 and the semi-conductive epoxy paint 43, when the transformer operated in normal service conditions, are connected to the system ground providing an electrical shielding for the fifth coil part 500. By grounding the conductive meshes 51 and the semi-conductive epoxy paint 43, the electric field inside the fifth coil part 500, which emanate from the windings, is confined inside the fifth coil part 500 and will not result in a shock hazard to human beings or animals coming in contact with the external shell surface. Also by grounding the conductive meshes 51 and the semi-conductive epoxy paint 43, a path to ground for the fault current is provided in the event of an internal electrical fault inside the fifth coil part 500.

Figure 13:
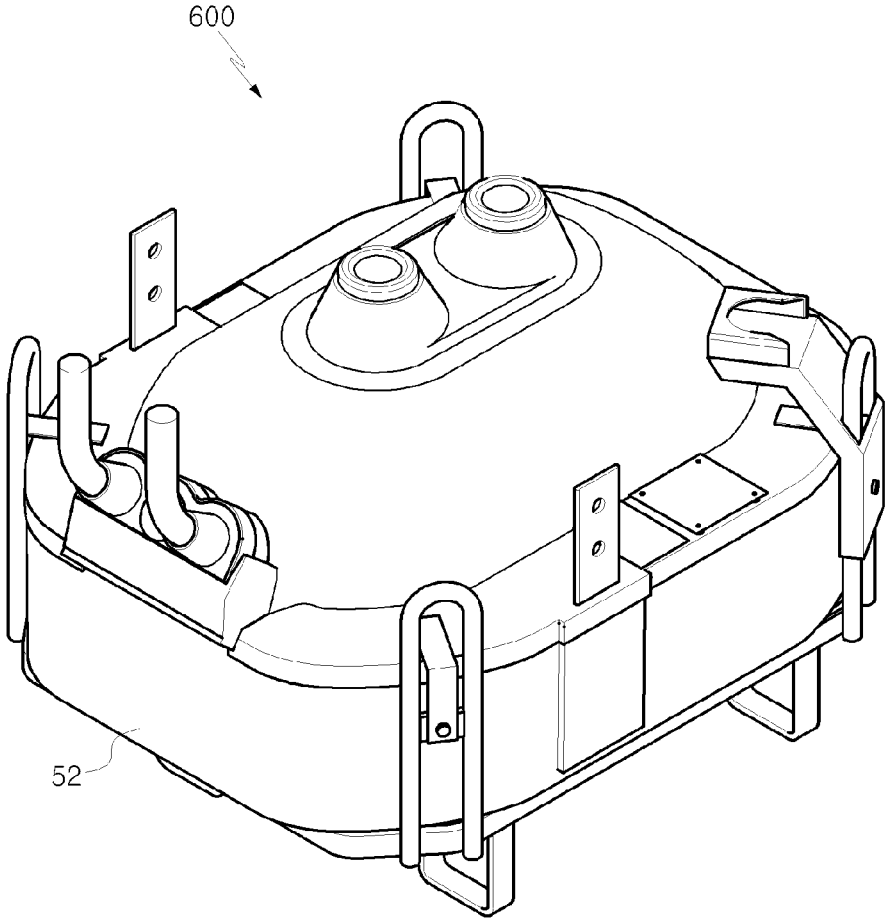
FIG. 13 shows schematically a transformer manufactured through the manufacturing method of a ground-buried type solid insulation transformer according to the present invention.

FIG. 13 shows a transformer manufactured through the manufacturing method of a ground-buried type solid insulation transformer according to the present invention. Referring to FIG. 13, the transformer 600 is manufactured finally such that the fifth coil part 500 which is attached with the conductive mesh 51 is assembled to the shell 52 made either of Vinlyester resin, Fiber Reinforced Polyester (FRP), or thermoplastic material At this time, silicone or high molecular weight compound is filled into the assembled shell 52 and thus after its solidification in a flexible material, the sealing and water-proofing of the transformer 600 can be obtained.

The transformer 600 may be tested through a ninth process S900.

A summary of a manufacturing method of ground-buried solid insulation transformer according to the present invention will be follows.

1) Preparing insulation material (not shown) to be cut into desired size.

2) Holding the insulation material on a holding device 60 and producing a coil form 10 into which inner window 11 is formed.

3) Winding low voltage coil 20 on an outer circumference of the coil form 10.

4) Winding glass fiber 22 and semi-conductive paper 23 on an outer circumference of the low voltage coil 20.

5) Winding high voltage coil 21.

6) Winding glass fiber 22 (second coil part 200)

7) Separating the second coil part 200 from the holding device 60 and assembling and inserting a first mold 30 into the inner window 11 of the second coil part 200.

8) Pre-heating the second coil part 200.

9) Putting the pre-heated second coil part 200 into a second mold 40 and injecting epoxy resin and hardener thereto and further controlling inside the second mold to predetermined speed, vacuum degree, pressure and temperature and automatically casting and curing, and producing a third coil part 300 of an epoxy layer being formed on outer part of the second coil part 200.

10) After-treating and curing the third coil part 300.

11) Cooling the third coil part 300 and applying semi-conductive coating material 43 (semi-conductive epoxy paint) to produce a fourth coil part 400.

12) Assembling a core 50 to the fourth coil part 400 to produce a fifth coil part 500 and testing the fifth coil part 500.

13) Attaching a conductive mesh 51 to the fifth coil part 500.
14) Assembling a shell 52 to an outer circumference of the fifth coil part 500 and filling silicone or high molecular weight compound between the fifth coil part 500 and the shell 52 to produce a transformer.
15) Testing the produced transformer.

While the present invention is described referring to the preferred embodiment, the present invention is not limited thereto, and thus various variation and modification can be made without departing from a scope of the present invention.

What is claimed is:

1. A manufacturing method of ground-buried-type solid insulation transformer comprising steps of:

producing a coil form into which an inner window is formed;

winding a low voltage coil and a high voltage coil on the coil form to produce a first coil part;

winding glass fiber on the first coil part to produce a second coil part and assembling a first mold into the inner window and then pre-heating the second coil part;

putting the second coil part into a second mold and injecting epoxy resin and hardener between the second coil part and the second mold, and automatically molding and curing thereof under predetermined speed, vacuum, pressure and temperature to produce a third coil part on outer circumference of which an epoxy layer is formed;

separating the first mold from the inner window of the third coil part and then after-treating and curing the third coil part;

cooling the after-treated and cured third coil part and sanding and washing the epoxy layer, and applying semi-conductive coating material to the sanded part to produce a fourth coil part;

assembling a core to the fourth coil part to produce a fifth coil part and testing the fifth coil part; and connecting the fifth coil part to a conductive mesh and shielding thereof, and then sealing outer side of the fifth coil part and filling silicone or high molecular weight compound between the fifth coil part and a shell to manufacturing the transformer.

2. The manufacturing method of ground-buried-type solid insulation transformer according to claim 1, further comprising testing the manufactured transformer.

3. The manufacturing method of ground-buried-type solid insulation transformer according to claim 1, wherein at least two or more of copper sheet, Insulation paper or film, glass fiber, semi-conductive paper, silicone and nitrile rubber are arranged on outer side of the low voltage coil.

4. The manufacturing method of ground-buried-type solid insulation transformer according to claim 1, wherein at least two or more of copper wires, Insulation paper or film, Insulation spacer, glass fiber material and self-fusing tape are wound in the winding of the high voltage coil.

5. The manufacturing method of ground-buried-type solid insulation transformer according to claim 4, wherein the Insulation spacer is affixed longitudinally to Insulation paper or film at the predetermined distance in order to facilitate for epoxy resin and hardener to be infiltrated thereinto.

6. The manufacturing method of ground-buried-type solid insulation transformer according to claim 4, wherein the high voltage winding is made of one of rectangular wire, round wire or flattened wire, made of aluminum or copper.

7. The manufacturing method of ground-buried-type solid insulation transformer according to claim 1, wherein the pre-heating process is performed at temperature between 80° C. and 250° C. for 8 hr to 20 hr.

8. The manufacturing method of ground-buried-type solid insulation transformer according to claim 1, wherein an automatic casting and curing process of the fourth process is performed on the condition that the second mold is kept at a temperature between 100° C. and 200° C., and the epoxy resin and hardener are kept at a temperature between 50° C. and 150° C. and under vacuum level between 1 mbar and 80 mbar during filling and mold pressure is maintained between 2 bar and 20 bar for 30 min to 2 hr.

9. The manufacturing method of ground-buried-type solid insulation transformer according to claim 1, wherein the third coil part is cured at a temperature between 100° C. and 200° C.

10. The manufacturing method of ground-buried-type solid insulation transformer according to claim 1, wherein the silicone or high molecular weight compound of the eighth process is filled at a temperature between 10° C. and 150° C. and maintained under vacuum level between 10 mbar and 200 mbar.

* * * * *